United States Patent [19]

Kogane

[11] Patent Number: 4,758,215

[45] Date of Patent: Jul. 19, 1988

[54] PHOTOGRAPHIC PAPER HANDLING APPARATUS

[75] Inventor: Mikio Kogane, Kanagawa, Japan

[73] Assignee: Fuji Photo Film Co., Ltd., Kanagawa, Japan

[21] Appl. No.: 909,395

[22] Filed: Sep. 19, 1986

[30] Foreign Application Priority Data

| | | | |
|---|---|---|---|
| Sep. 19, 1985 | [JP] | Japan | 60-142954[U] |
| Sep. 19, 1985 | [JP] | Japan | 60-207182 |
| Sep. 19, 1985 | [JP] | Japan | 60-207180 |
| Sep. 19, 1985 | [JP] | Japan | 60-207183 |
| Sep. 19, 1985 | [JP] | Japan | 60-207181 |

[51] Int. Cl.[4] ..... G03D 15/04; B65H 45/101; B65H 45/20

[52] U.S. Cl. ..... 493/357; 493/320; 493/324; 493/362; 493/363; 493/414; 493/448; 355/29

[58] Field of Search ..... 355/28, 29, 50; 493/320, 324, 325, 356, 357, 358, 359, 360, 361, 362, 363, 364, 365, 414, 448

[56] References Cited

U.S. PATENT DOCUMENTS

| | | | |
|---|---|---|---|
| 2,202,244 | 5/1940 | Butterfield | 493/362 |
| 2,675,747 | 4/1954 | Greiner et al. | 493/360 |
| 3,231,261 | 7/1966 | Huffman | 493/359 |
| 3,718,807 | 2/1973 | Bracken et al. | 355/29 |
| 3,844,253 | 10/1974 | Staub et al. | 355/29 |
| 4,500,307 | 2/1985 | Bridgeman | 493/365 |
| 4,655,069 | 4/1987 | Remy et al. | 72/311 |

*Primary Examiner*—Frederick R. Schmidt
*Assistant Examiner*—William E. Terrell
*Attorney, Agent, or Firm*—Sughrue, Mion, Zinn, Macpeak, and Seas

[57] ABSTRACT

A photographic paper handling apparatus for handling a photographic paper in a continuous form having a plurality of images sequentially printed thereon in the longitudinal direction thereof is provided with a cutting-perforating section and a folding section. In the cutting-perforating section, the photographic paper which is transported along a photographic paper transport passage is cut into pieces each including a series of images printed in accordance with the order placed by each individual customer, and a perforation is provided in an area of each of the cut pieces of photographic paper which is defined between each pair of adjacent images. In the folding section, each of the cut and perforated pieces of photographic paper is folded along each perforation. Accordingly, it is possible to prevent prints processed in accordance with one order from being mixed with those in accordance with another order.

37 Claims, 15 Drawing Sheets

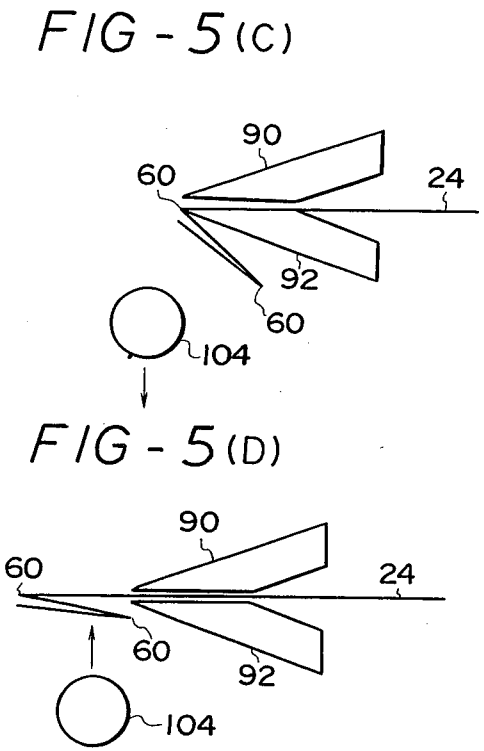
FIG - 5 (C)
FIG - 5 (D)
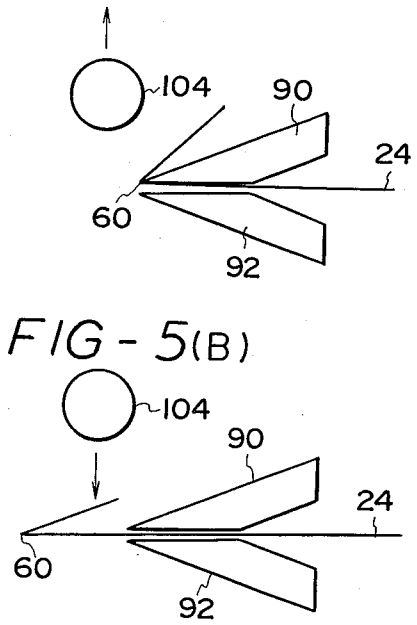
FIG - 5 (A)
FIG - 5 (B)

348
352
338
350
310
340
350
346

348
352
338
350
310
340
350
346

348
352
358B
338
350
310
340
350
346

348
352
338
352
350
310
340
350
346

348
352
338
350
310
340
350
346
358B 348
352
338
350
310
340
350
346

PHOTOGRAPHIC PAPER HANDLING APPARATUS

BACKGROUND OF THE INVENTION

1. Field of the Invention

The present invention relates to an apparatus for handling a photographic paper in a continuous form having a plurality of images sequentially printed thereon.

2. Description of the Related Art

At a photo processing shop, a customer is generally given prints, which have been obtained from an exposed negative film, in the form of being cut for each of the images recorded on the film.

However, when a multiplicity of prints need to be simultaneously put on an album or the like according to a particular classification, it is preferable that a multiplicity of prints processed in accordance with each order placed by a customer be formed such as to be continuous and readily separable from each other according to need.

SUMMARY OF THE INVENTION

In view of the above-described circumstances, it is a primary object of the present invention to provide a photographic paper handling apparatus in which images are sequentially printed on a photographrc paper in a continuous form, and the photographic paper is cut into pieces each including a plurality of images printed in accordance with the order placed by each individual customer, and a perforation is provided in an area of each of the cut pieces of photographic paper which is defined between each pair of adjacent images so that the prints are readily separable from each other according to need.

To this end, the present invention provides a photographic paper handling apparatus for handling a photographic paper in a continuous form having a plurality of images sequentially printed thereon, which cimprises: a first section in which the photographic paper, which is transported along a photographic paper transport passage, is cut into pieces each including a series of images printed in accordance with the order placed by each individual customer, and a perforation is provided in an area of the photographic paper which is defined between each pair of adjacent images; and a second section disposed on the downstream side of the first section in the photographic paper transport direction, in which each of the cut and perforated pieces of photographic paper is folded along each perforation.

Thus, according to the present invention, a continuous photographic paper, which has a plurality of images printed thereon from a series of negative films for which individual customers have placed orders for printing, is cut into pieces each including a series of images for each individual customer, and a perforation is provided in an area of each of the cut pieces of photographic paper which is defined between each pair of adjacent images. Accordingly, when a customer arranges a plurality of series of prints, which were made in accordance with the orders placed on different occasions, in order to put them on an album or the like, since each series of prints are continuous with each other through the perforations, there is no fear of prints processed in accordance with one order being mixed with those in accordance with another order. In addition, it is possible to separate prints from each other at the perforated portions and put them at any desired separate positions on an album or the like.

According to need, each series of prints may be folded in a zigzag shape along the perforations and inserted into a casing or the like. In such case, there is no fear of the prints being scattered.

DESCRIPTION OF THE PREFERRED EMBODIMENTS

Figure 1:
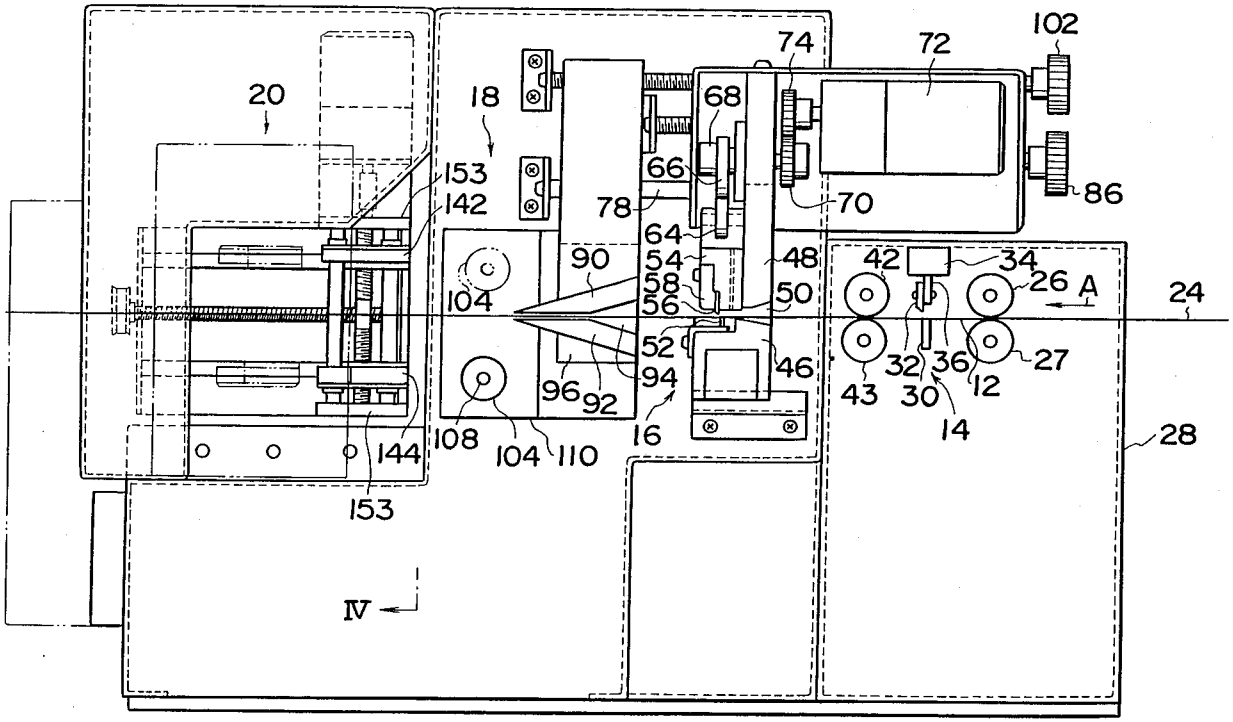
FIG. 1 is a front view of first embodiment of the photographic paper handling apparatus according to the present invention.

FIG. 1 shows a photographic paper handling apparatus 10 in accordance with a first embodiment of the present invention. The apparatus 10 includes a cutting section 14, a perforating section 16, a folding section 18, a transfer section 20 and an accommodating section 22 (see FIG. 3), which are disposed along a photographic paper tranport passage 12.

A photographic paper 24 is transported along the transport passage 12 in the direction of the arrow A. A printer (not shown) for printing images on the photographic paper 24 is disposed on the upstream side of the photographic paper transport passage 12.

A pair of clamping feed rollers 26 and 27 are disposed at the intermediate portion of the photographic paper transport passage 12 and rotatably supported by a machine frame 28 so that the photographic paper 24 which has been subjected to printing and developing operations is fed into the cutting section 14.

Cutting Section 14

In the cutting section 14, a fixed blade 30 is disposed on one side of the photographic paper transport passage 12, and a movable blade 32 on the other side. The movable blade 32 is rigidly fixed to an actuator 36 of a solenoid 34 which is secured to the machine frame 28, so that the photographic paper 24 is cut at each of the cutting portions 38 (see FIG. 2) by the cooperation of the fixed and movable blades 30 and 32 by virtue of the driving force derived from the solenoid 34. As a means for driving the movable blade 32, a motor or other similar driving means may be employed in place of the solenoid 34.

Figure 2:
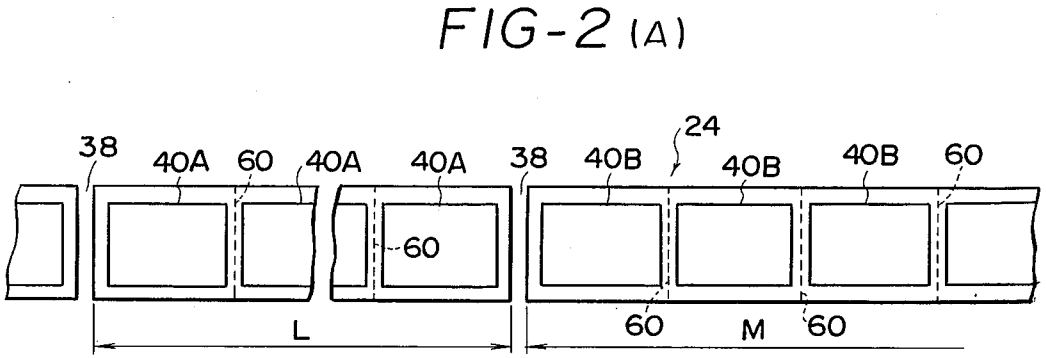
FIG. 2(A) is a plan view of a photographic paper in a continuous form which is to be transported.
FIG. 2(B) is a perspective view of the photographic paper which has already been folded.
FIG. 2(C) is a perspective view of the comb-like blade employed in the embodiment shown in FIG. 1.
Figure 2:
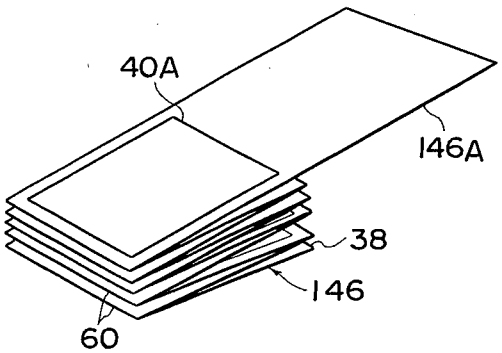
Figure 2:
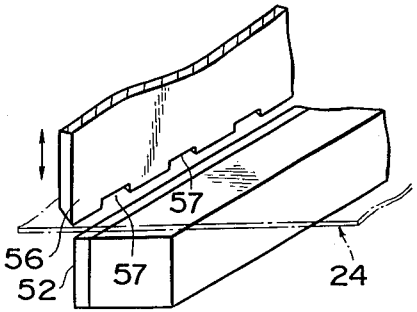

More specifically, the photographic paper 24 is produced such as to have a continuous form and wound up in the shape of a roll. As shown in FIG. 2, the photographic paper 24 has a plurality of images 40A and 40B sequentially printed thereon by means of a printer (not shown) disposed on the upstream side of the photographic paper transport passage 12. A series of images 40A and another series of images 40B are printed in correspondence with negative films for which two different customers placed orders for printing. Thus, the photographic paper 24 is cut into a length L including all the images 40A printed in accordance with the order placed by one customer, and then cut into a length M including all the images 40B printed in accordance with another customer's order.

Each piece of the photographic paper 24 thus cut is advanced to the perforating section 16 by the action of a pair of clamping feed rollers 42 and 43 disposed on the downstream side of the cutting section 14 in the photographic paper transport direction.

Perforating Section 16

In the perforating section 16, lower and upper fixed plates 46 and 48 are rigidly secured to the machine frame 28 in such a manner that they define therebetween a gap 50 for passing the photographic paper 24.

A support plate 52 is rigidly secured to the lower fixed plate 46 so as to provide a surface for mounting the photographic paper 24 thereon.

A movable plate 54 is vertically movably provided on the upper fixed plate 48, and a comb-like blade 56 is rigidly secured to the movable plate 54 by a blade holder 58. As shown in FIG. 2(C), the comb-like blade 56 has a plurality of recesses 57 at the distal or lower end thereof which define a comb-like configuration as a whole. The comb-like blade 56 is moved up and down together with the movable plate 54 in such a manner that the blade 56 moves in and out of the photographic paper transport passage 12. In this way, the comb-like blade 56 is capable of providing perforations 60 (see FIGS. 2(A) and 2(B)) in the photographic papers 24 mounted on the support plate 52.

The movable plate 54 is biased upward as viewed in FIG. 1 by means of the force from a resilient member (not shown), so that a roller 64 which is rotatably supported at the upper end of the movable plate 54 is in contact with an eccentric cam 66. This cam 66 has a shaft 68 rotatably supported by the upper fixed plate 48, and a gear 70 is rigidly secured to the distal end portion of the shaft 68 which projects from the upper fixed plate 48. The gear 70 is meshed with a gear 74 provided on the output shaft of a motor 72. Accordingly, as the motor 72 is rotated, the eccentric cam 66 is rotated in such a manner as to move the movable plate 54 downward, thus causing the comb-like blade 56 to form a perforation 60 in the photographic paper 24.

Figure 3:
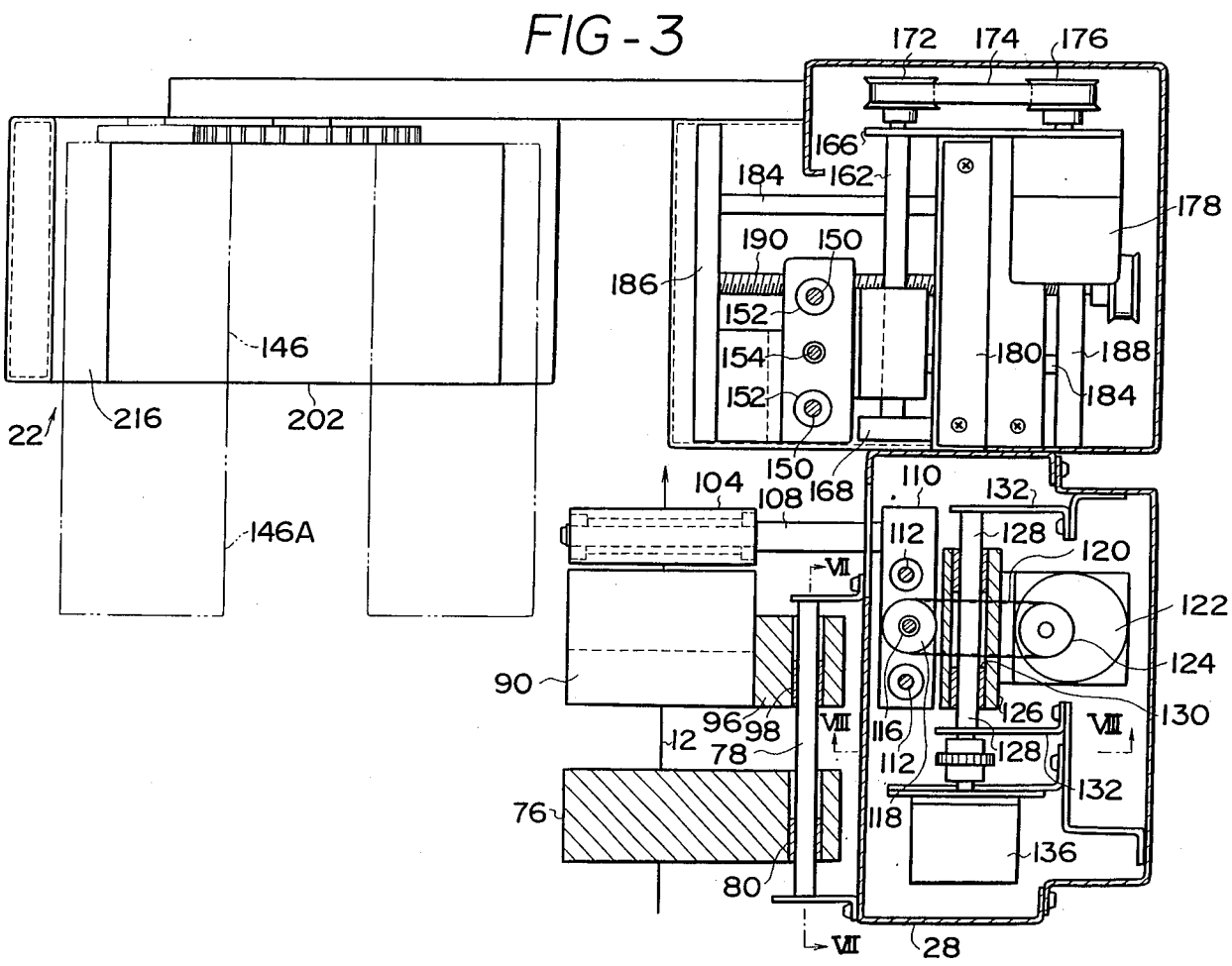
FIG. 3 is a plan view of the embodiment shown in FIG. 1.
Figure 7:
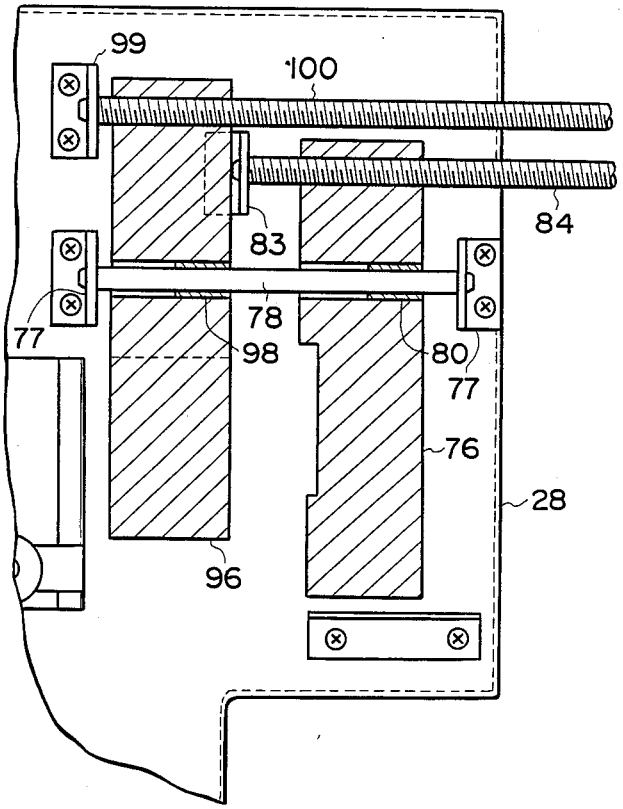
FIG. 7 is a sectional view taken along the line VII—VII in FIG. 3.

A bracket 76 which is shown in FIGS. 3 and 7 is extended from the lower and upper fixed plates 46 and 48. This bracket 76 is supported through a bearing 80 on a slide bar 78 which is stretched along the machine frame 28 in such a manner that both ends of the bar 78 are supported by the machine frame 28 through small brackets 77, respectively. The bearing 80 enables the perforating section 16 to be moved along the photographic paper transport passage 12.

As shown in FIG. 7, a drive shaft 84 is rotatably supported by the machine frame 28 through a small bracket 83 in such a manner that the shaft 84 extends parallel to the slide bar 78. The drive shaft 84 has an external thread cut in the outer periphery thereof so that the shaft 84 is in thread engagement with the bracket 76, thereby allowing the bracket 76 to move the perforating section 16 along the slide bar 78 in response to the rotation of the drive shaft 84. An adjusting knob 86 (see FIG. 1) is rigidly secured to the distal or outer end of the drive shaft 84 so as to allow an operator to turn the shaft 84 using the knob 86. Thus, it is possible for the operator to finely adjust the perforating section 16 along the photographic paper transport passage 12 by turning the adjusting knob 86, so that the position of the photographic paper 24 at which a perforation 60 (see FIG. 2) is to be formed can be adjusted according to the size of the images 40A and 40B.

Folding Section 18

In the folding section 18, a pair of folding guides 90 and 92 are provided along the photographic paper transport passage 12. These folding guides 90 and 92 each having a wedge-like cross-section are disposed on both sides, respectively, of the photographic paper transport passage 12 in such a manner that they define therebetween a gap 94 for passing the photographic paper 24. The respective distal end portions of the folding guides 90 and 92 are gradually reduced in wall thickness and disposed such as to face downstream in the photographic paper transport direction, thereby a photographic paper outlet portion therebetween.

These folding guides 90 and 92 are supported by a bracket 96 which is supported on a slide bar 78 through a bearing 98 in a manner similar to that of the perforating section 16.

As shown in FIG. 7, the bracket 96 is in thread engagement with a drive shaft 100 which is rotatably supported by the machine frame 28 through a small bracket 99 and which extends parallel to the slide bar 78. An adjusting knob 102 (see FIG. 1) is rigidly secured to one end of the drive shaft 100. Thus, the operator can finely adjust the folding section 18 along the photographic paper transport passage 12 by turning the knob 102 in a manner similar to that in the perforating section 16 to adjust the position of the photographic paper 24 at which it is folded.

As shown in FIG. 1, a bending roller 104 is disposed in opposing relation to the respective distal ends of the folding guides 90 and 92. This roller 104 is adapted to be movable across the photographic paper transport passage 12, and the axis of the roller 104 extends in the lateral direction of the photographic paper 24 which is transported along the photographic paper transport passage 12.

The bending roller 104 is rotatably supported on a support shaft 108 which is in thread engagement with a bracket 110 so as to be rigidly secured thereto.

As shown in FIG. 3, a pair of guide bars 112 extend vertically through the bracket 110 through respective bearings 114 so that the bracket 110 is movable in a direction perpendicular to the plane of the photographic paper 24 tansported along the transport passage 12.

Figure 5:
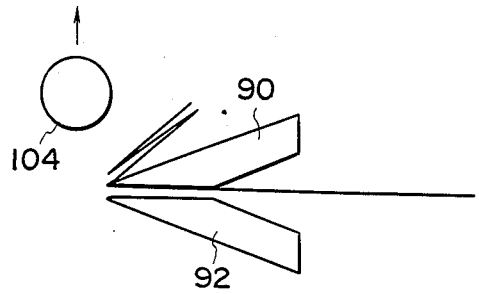
FIGS. 5(A) to 5(G) show in combination the way in which the photographic paper is folded.
Figure 5:
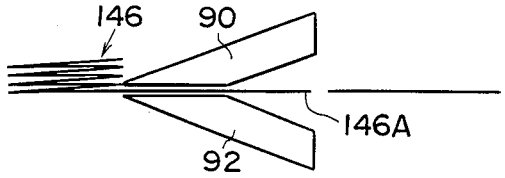
Figure 5:
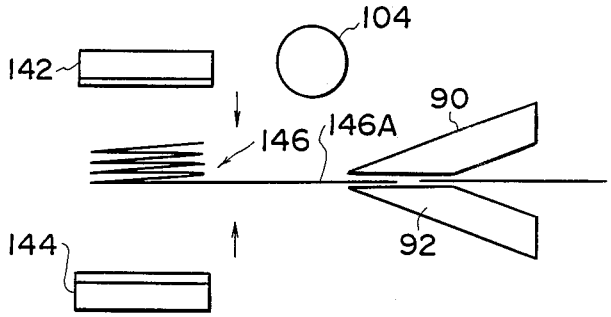

A drive shaft 116 is disposed in between these guide bars 112 such as to extend parallel to the latter, the shaft 116 being in thread engagement with the bracket 110. A pulley 118 is rigidly secured to one end portion of the drive shaft 116, and a timing belt 120 is passed over this pulley 118. The timing belt 120 is further passed over a pulley 124 rigidly secured to the output shaft of a motor 122, so that the bracket 110 is reciprocatable in the vertical direction as viewed in FIG. 1 together with the bending roller 104 in response to the rotation of the motor 122. In consequence, when the bending roller 104 is reciprocated vertically as shown in FIG. 5 in a state wherein the photographic paper 24 is being advanced such as to project from the distal ends of the folding guides 90 and 92, the photographic paper 24 is successively folded. The paper 24 is folded along each perforation 60.

Figure 8:
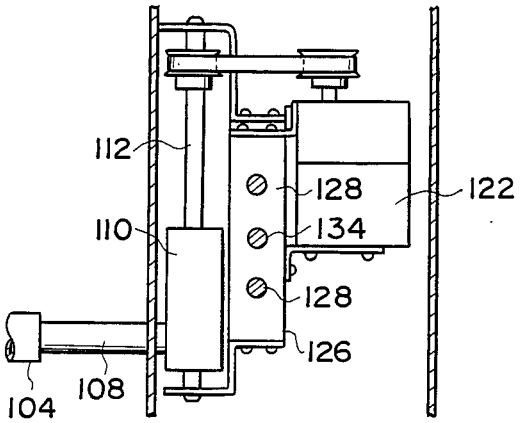
FIG. 8 is a sectional view taken along the line VIII—VIII in FIG. 3.

The bracket 110 and the motor 122 are rigidly secured to a movable plate 126. As shown in FIG. 8, a pair of guide bars 128 extend through this movable plate 126 to guide the movable plate 126 through respective bearings 130 in such a manner that the movable plate 126 is movable along the photographic paper transport passage 12. Both ends of each of the guide bars 128 are rotatably supported by the machine frame 28 through a pair of brackets 132, respectively.

A drive shaft 134 extends parallel to the guide bars 128 and is rotatably supported at both ends thereof by the brackets 132. The intermediate portion of the drive shaft 134 is in thread engagement with the movable plate 126. One end portion of the drive shaft 134 projects from one of the brackets 132, and the output shaft of a motor 136 is connected to the projecting end of the drive shaft 134. Accordingly, the motor 136, when rotating, is able to move the movable plate 126 along the photographic paper transport passage 12, thereby allowing the bending roller 104 to be separated from the folding guides 90 and 92. Thus, even when the thickness of the photographic paper 24 which is successively folded at the distal ends of the folding guides 90 and 92 has become relatively large as shown in FIG. 5(F), the photographic paper 24 is allowed to be reliably folded along each perforation 60.

Transfer Section 20

Figure 4:
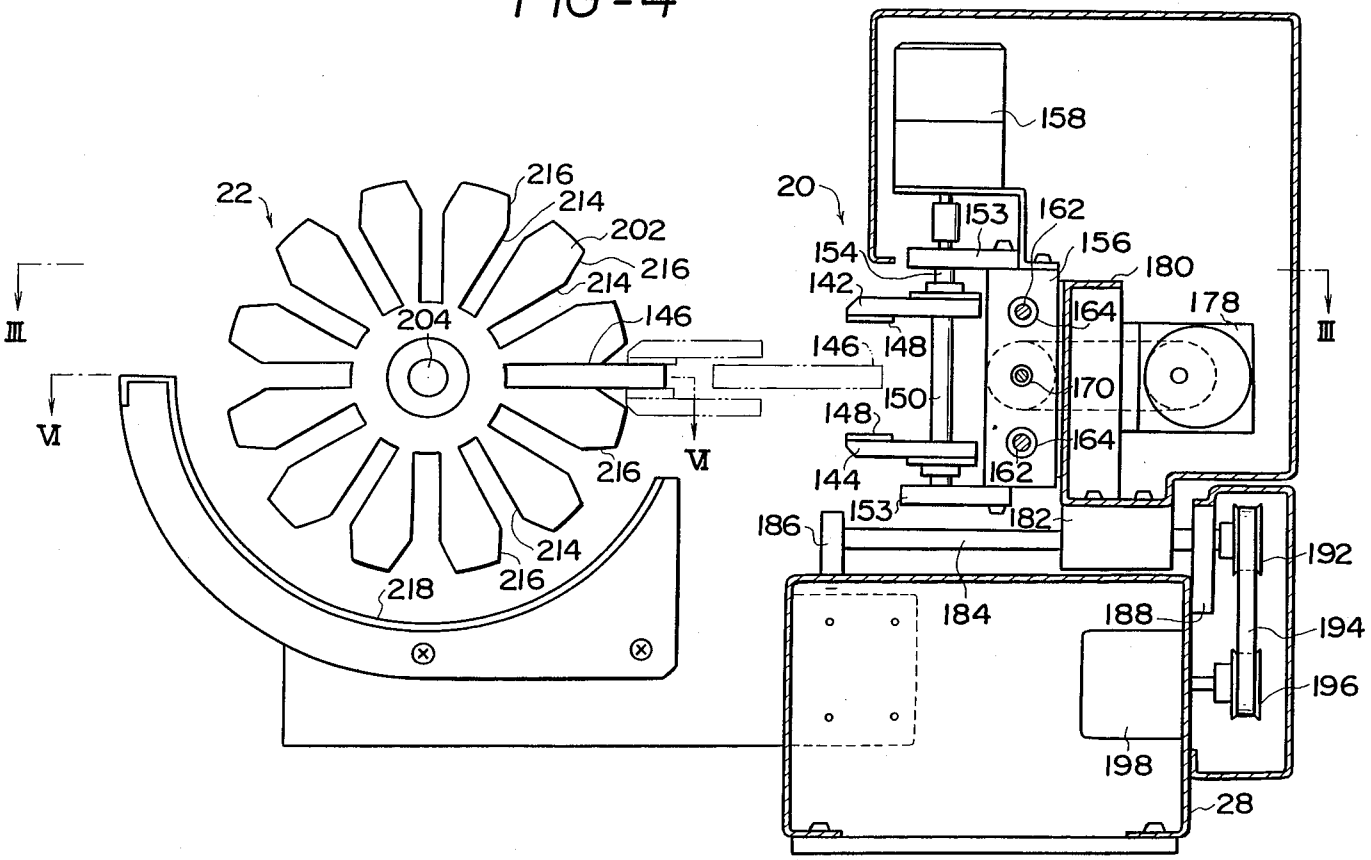
FIG. 4 is a sectional view taken along the line IV—IV in FIG. 1.

In the transfer section 20, as will be clear from FIG. 4, the photographic paper 146 which has been folded in a bundle is clamped by a pair of clamping plates 142 and 144 in the direction of the thickness of the folded paper 146. Rubber plates 148 are respectively secured to the opposing surfaces of the clamping plates 142 and 144 so as to prevent any damage to the folded photographic paper 146.

As shown in FIG. 3, a pair of guide bars 150 extend through the clamping plates 142 and 144 so that the plates 142 and 144 are slidably guided along the guide bars 150 through bearings 152. Thus, the clamping plates 142 and 144 are allowed to move toward and away from each other. Both ends of each of the guide bars 150 are rigidly secured to brackets 153, respectively.

A drive shaft 154 is disposed in between these guide bars 150 so as to extend parallel therewith. Both ends of the drive shaft 154 are rotatably supported by the brackets 153 so as to be supported by a movable plate 156 together with the guide bars 150 through the brackets 153 as shown in FIG. 4. A motor 158 is rigidly secured to the movable plate 156, the output shaft of the motor 158 being connected to the drive shaft 154. Accordingly, in response to the rotation of the motor 158, the pair of clamping plates 142 and 144 are activated to move toward or away from each other so as to clamp or release the folded photographic paper 146.

A pair of guide bars 162 extend through the movable plate 156 in a direction perpendicular to the longitudinal axes of the guide bars 150, so that the movable plate 156 is guided in the longitudinal axes of the guide bars 162 through bearings 164. Both ends of each of the guide bars 162 are rotatably supported by brackets 166 and 168, respectively, as shown in FIG. 3.

A drive shaft 170 is disposed in between the pair of guide bars 162 so as to extend parallel therewith. The intermediate portion of the drive shaft 170 is in thread engagement with the movable plate 156, and both ends of the drive shaft 170 are rotatably supported by brackets 166 and 168, respectively, one end portion of the drive shaft 170 projecting from the bracket 166 and having a pulley 172 rigidly secured thereto. A timing belt 174 is passed over this pulley 172 and another pulley 176 so that the belt 174 is stretched therebetween, the pulley 176 being rigidly secured to the output shaft of a motor 178 which, in turn, is rigidly secured to the bracket 166.

Accordingly, the pair of clamping plates 142 and 144 are movable along the drive shaft 170 in response to the rotation of the motor 178 from the solid line position shown in FIG. 1 to the imaginary line position. The solid line position shown in FIG. 1 defines a receiving position at which the clamping plates 142 and 144 receive the folded photographic paper 146 from the folding section 18.

The brackets 166 and 168 are supported by a movable plate 180 which is in turn supported by a movable block 182 as shown in FIG. 4. This movable block 182 is guided by a pair of parallel guide bars 184 extending therethrough as shown in FIG. 3. These guide bars 184 are rotatably supported by the machine frame 28 through brackets 186 and 188.

A drive shaft 190 (see FIG. 3) is disposed in between the guide bars 184. Both ends of the drive shaft 190 are rotatably supported by the brackets 186 and 188, respectively, in such a manner that the shaft 190 extends parallel to the guide bars 184. In addition, the drive shaft 190 extends through the movable block 182, the intermediate portion of the shaft 190 being in thread engagement with the block 182.

One end portion of the drive shaft 190 projects from the bracket 188, and a pulley 192 is rigidly secured to the projecting end portion of the shaft 190 as shown in FIG. 4. A timing belt 194 is passed over this pulley 192 and another pulley 196 so that the belt 194 is stretched therebetween, the pulley 196 being rigidly secured to the output shaft of a motor 198 which, in turn, is rigidly secured to the machine frame 28.

Accordingly, the movable block 182 is movable in response to the rotation of the motor 198 together with the clamping plates 142 and 144 leftwardly from the solid line position thereof shown in FIG. 4 to the imaginary line position thereof. The imaginary line position of the clamping plates 142 and 144 shown in FIG. 4 defines a transfer position at which the clamping plates 142 and 144 insert the folded photographic paper 146 into the accommodating section 22.

Accommodating Section 22

Figure 6:
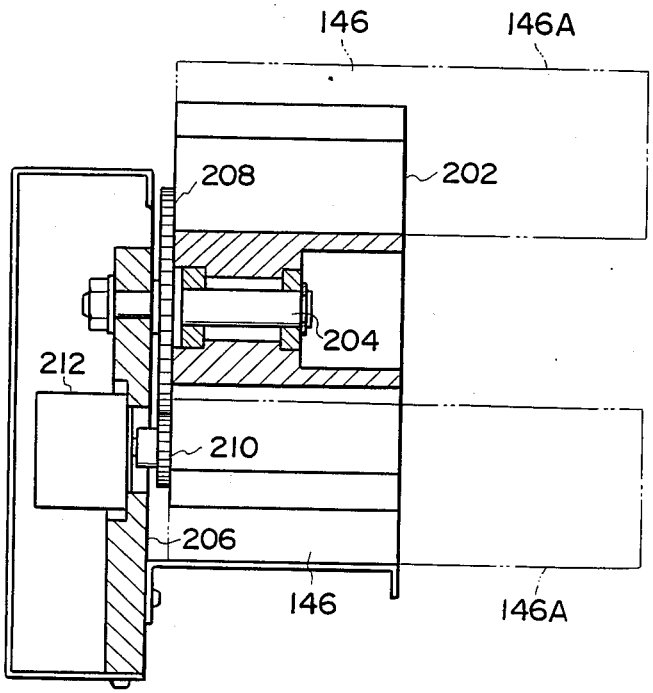
FIG. 6 is a sectional view taken along the line VI—VI in FIG. 4.

In the accommodating section 22, a photographic paper cassette drum 202 is rigidly secured to a rotary shaft 204 as shown in FIGS. 3, 4 and 6. This rotary shaft 204 is rotatably supported by a bracket 206 in a cantilever fashion. A gear 208 is rigidly secured to the rotary shaft 204, the gear 208 being meshed with a gear 210 rigidly secured to the output shaft of a motor 212 which is supported by the bracket 206.

Thus, the cassette drum 202 is rotatable in response to the rotation of the motor 212.

The cassette drum 202 is, as clearly shown in FIG. 4, provided with a plurality of accommodating grooves 214 which extend in the radial direction, so that the folded photographic paper 146 is inserted into one accommodating groove 214 from the transfer section 20. The accommodating grooves 214 are formed in such a manner as to extend through the cassette drum 202 in the axial direction thereof (in the horizontal direction as viewed in FIG. 6). Thus, each accommodating groove 214 allows the folded photographic paper 146 to be inserted therein in a state wherein the paper 146 has the tail end portion 146A projecting from the folded portion of the paper 146 as shown in FIG. 2(B). In addition, the radially outer end portion of each accommodting groove 214 is enlarged to define an enlarged portion 216 which allows the folded photographic paper 146 to be readily inserted thereinto.

In the accommodating section 22, a cover 218 having a substantially semi-circular corss-section is disposed below the cassette drum 202 for the purpose of preventing the folded photographic paper 146 from accidentally coming out of the accommodating groove 214 during the rotation of the cassette drum 202.

The following is a description of the operation of the embodiment arranged as detailed above.

The photographic paper 24 which has already been subjected to printing and developing operations is transported along the photographic paper transport passage 12 in the direction of the arrow A to reach the cutting section 14. In the cutting section 14, the solenoid 34 is activated to cut the paper 24 at each of the cutting areas 38 on the basis of the print data which has already been input, thereby separating the paper 24 into pieces each including a series of images 40A or 40B which are sequentially printed on the paper 24 in accordance with the order placed by each individual customer.

In the perforating section 16, each cut piece of the photographic paper 24 is provided with a perforation 60 in an area between each pair of adjacent images 40A or 40B by means of the comb-like blade 56 which is moved up and down in response to the rotation of the motor 72. In order to accurately form a perforation 60 in the central portion between each pair of adjacent images 40A or 40B, the operator turns the adjusting knob 86 in accordance with the size of the images 40A or 40B in such a manner that the position of the perforating section 16 is finely adjusted in the horizontal direction as viewed in FIG. 1. The drive shaft 84 may be turned by a motor or other similar means in response to the output of a sensor means which detects the position of each image 40A and reads off a mark (not shown) formed on the area between each pair of adjacent images 40A.

The piece of photographic paper 24 provided with the perforations 60 is advanced to the folding section 18. In this section 18, every time the photographic paper 24 projects from the respective distal ends of the folding guides 90 and 92 by a length corresponding to the length of each image 40A, the bending roller 104 is activated to reciprocate once in the vertical direction as viewed in FIG. 1. The reciprocation of the bending roller 104 is effected by rotating the motor 122 back and forth. The way in which the photographic paper 24 is folded is shown in FIG. 5 in detail.

Referring to FIG. 5(A), when the leading end portion of the photographic paper 24 projects from the distal ends of the folding guides 90 and 92 by a length corresponding to the length between the leading end of the paper 24 and the first perforation 60, the bending roller 104 is moved upward so as to bend the paper 24 in one direction along the perforation 60 against the distal end of the folding guide 90.

When the photographic paper 24 is further advanced a length corresponding to the length between the first and second perforations 60 as shown in FIG. 5(B), the folded portion of the paper 24 passes the bending roller 104. At this time, the roller 104 is moved downward, and this causes the paper 24 to be bent along the second perforation 60 in the other direction against the distal end of the folding guide 92, as shown in FIG. 5(C). When the paper 24 is further advanced a length corresponding to the length between the second and third perforations 60, the bending roller 104 is moved upward again, thus causing the paper 24 to be bent along the third perforation 60 in the first direction against the distal end of the folding guide 90, as shown in FIG. 5(E).

In this way, the photogrpahic paper 24 is folded along the perforations 60 in a zigzag shape to define a folded photographic paper 146 as shown in FIG. 5(F).

The motor 136 is rotated in response of the above-described folding operation so as to cause the bending roller 104 to gradually move leftward as viewed in FIG. 5 as the thickness of the folded photographic paper 146 increases. Therefore, the photographic paper 24 can accurately be folded along each perforation 60 at all times.

The rear end portion 146A of the folded photographic paper 146 is not folded but allowed to project from the folded portion. Thereafter, when this end portion 146A reaches the area between the folding guides 90 and 92, the activation of the bending roller 104 is suspended. In consequence, the folded photographic paper 146 is inserted into the area between the clamping plates 142 and 144 which stand by at the receiving position, as shown in FIG. 5(G).

Then, the motor 158 in the transfer section 20 is activated to move the clamping plates 142 and 144 toward each other so as to clamp the folded photographic paper 146 therebetween.

Thereafter, the motors 178 and 198 are activated to move the clamping plates 142 and 144 to the imaginary line position shown in FIG. 4 so as to insert the folded photographic paper 146 into one accommodating groove 214 in the accommodating section 22.

The clamping plates 142 and 144 are then returned to the solid line position shown in FIGS. 3 and 4 by reversing the motors 178 and 198 to stand by for the insertion of a subsequent folded photographic paper 146. The cassette drum 202 is rotated by the operation of the motor 212 until a subsequent accommodating groove 214 reaches a position which faces the transfer section 20.

Thus, since each folded photographic paper 146 is inserted into an accommodating groove 214, there is no fear of the folded photographic paper 146 being accidentally scattered, so that the handling of the photographic paper is conveniently facilitated.

Each folded photographic paper 146 is thereafter drawn out of the cassette drum 202 and handed to the customer. In this case, the folded photographic paper 146 may be inserted into a frame-like casing, or fastened with a rubber band or other similar means.

In addition, the arrangement may be such that a frame-like small cassette having, e.g., a U-shaped cross-section is inserted in each accommodating groove 214 in the cassette drum 202 in advance, and a folded photographic paper 146 is inserted into each small cassette, which is thereafter drawn out of the cassette drum together with the photographic paper.

Figure 9:
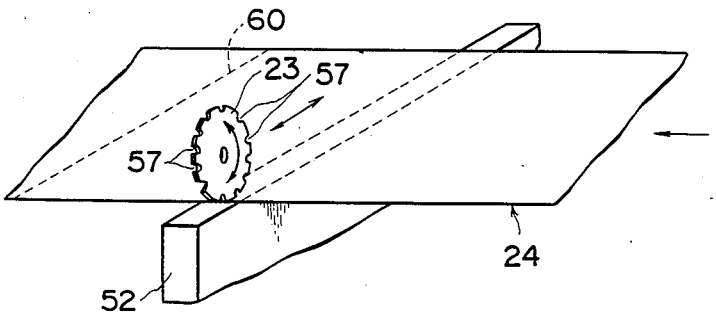
FIGS. 9 to 11 are perspective views respectively showing second to fourth embodiments of the present invention.
Figure 10:
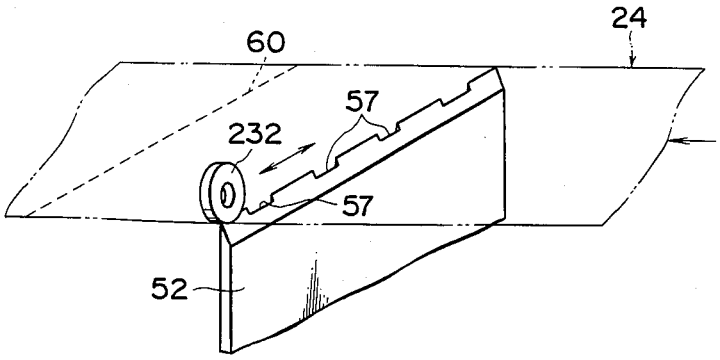
Figure 11:
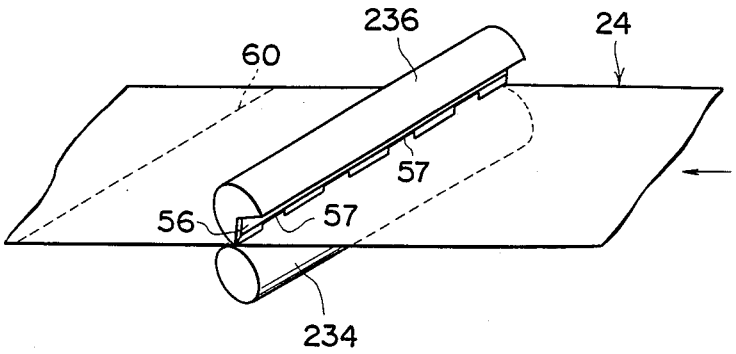

FIGS. 9 to 11 respectively show the arrangements of perforating means in accordance with second to fourth embodiments of the present invention.

In the second embodiment shown in FIG. 9, a blade 230 having a circular cross-section is adapted to roll on the fixed blade 52, which defines a support plate, in the lateral direction of the photographic paper 24, thereby force-cutting the paper 24. The circular blade 230 has recesses 57 cut in the outer periphery thereof at a predetermined regular spacing so that the paper 24 is allowed to have a row of uncut portions, thus providing a perforation 60 in the paper 24.

The third embodiment shown in FIG. 10 is arranged such that a roller 232 rolls on the fixed blade 52 through the photographic paper 24 sandwiched therebetween. In this embodiment, recesses 57 are cut in the fixed blade 52 at a predetermined regular spacing so as to allow the photographic paper 24 to have a row of uncut portions when it is force-cut by the cooperation of the fixed blade 52 and the roller 232, thereby providing a perforation 60 in the paper 24.

In the fourth embodiment shown in FIG. 11, the photographic paper 24 is clamped between a pair of rollers 234 and 236 so as to be advanced thereby. A fourth of one roller 234 is cut as viewed in the axial direction thereof, and a comb-like blade 56 which is similar to that in the first embodiment is rigidly secured to this cut portion. Accordingly, the comb-like blade 56, when rotating together with the roller 234, is able to provide a perforation 60 in the photographic paper 24 clamped between the rollers 234 and 236.

Figure 12:
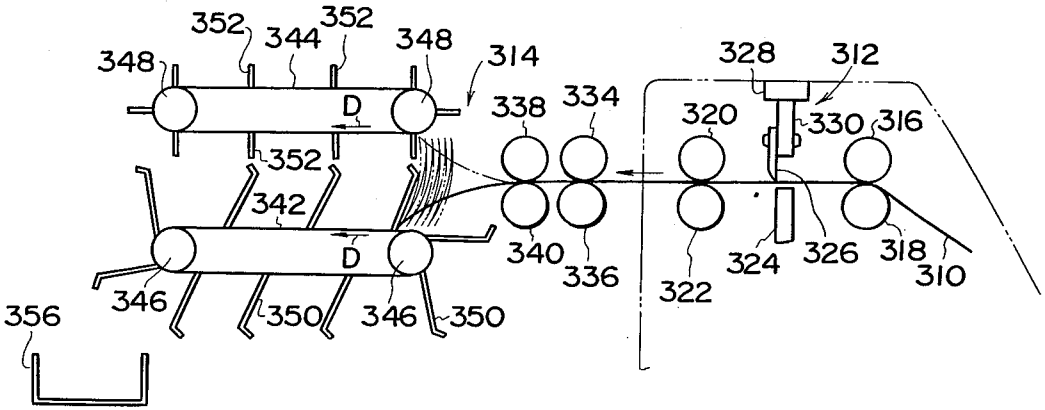
FIG. 12 is a sectional view of a fifth embodiment of the present invention.

FIG. 12 shows a fifth embodiment of the photographic paper handling apparatus according to the present invention. This embodiment is arranged such that a photographic paper 310 in a continuous form is processed in a cutting-perforating section 312 and a folding section 314.

The photographic paper 310 which is to be fed into the cutting-perforating section 312 has images sequentially printed thereon in a previous step (not shown) and has already been subjected to developing and drying operations.

In the cutting-perforating section 312, the photographic paper 310 is transported by the action of a pair of guide rollers 316 and 318 and advanced forward to the folding section 14 through a pair of guide rollers 320 and 322.

Fixed and movable cutters 324 and 326 are respectively disposed on both sides of a portion of the photographic transport passage between the pairs of guide rollers 316, 318 and 320, 322. The movable cutter 326 is rigidly secured to an actuator 330 of a solenoid (or a motor) 328 which serves as driving means, so that, when the solenoid 328 is activated, the movable cutter 325 is moved across the photographic paper transport passage so as to perforate or cut the photographic paper 310.

Figure 13:
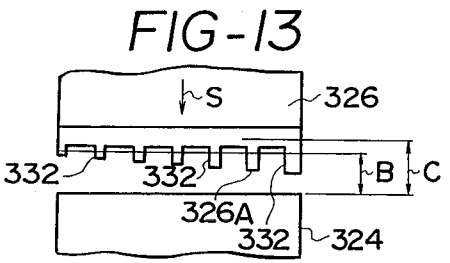
FIG. 13 is a front view of the cutter employed in the embodiment shown in FIG. 12.

As shown in FIG. 13, the cutting edge 326A of the movable cutter 326 is slanted, that is, the cutting edge 326A is inclined with respect to a line perpendicular to the direction (indicated by the arrow S) in which the movable cutter 326 moves to effect a cutting operation. Thus, the cutting edge 326A is capable of cutting the photographic paper 310 from one lateral edge thereof.

A plurality of rectangular grooves 332 are formed in the cutting edge 326A at a predetermined regular spacing in the lateral direction of the movable cutter 326 (in the horizontal direction as viewed in FIG. 13), so that, when the movable cutter 326 cuts the photographic paper 310, the rectangualr grooves 332 allow the paper 310 to have a row of uncut portions, thereby providing a perforation in the paper 310.

The depth (the vertical dimension as viewed in FIG. 13) of the rectangular grooves 332 is varied in the lateral direction of the movable cutter 326. More specifically, the above-described depth of the rectangular grooves 332 is the depth of cut measured from the distal end of the cutting edge 326A, and one lateral end of the movable cutter 326 (the right-hand end a viewed in FIG. 13) at which the cutting edge 326A is relatively long has the largest depth of cut, while the other end of the movable cutter 326 has the smallest depth of cut. However, the respective bottom surfaces of the rectangular grooves 332 are at the same distance from the distal end of the fixed cutter 324.

Accordingly, the movable cutter 326 enables the photographic paper 310 to be selectively perforated or cut by changing the working stroke, i.e., the depth of cut, of the movable cutter 326.

More specifically, when the working stroke of the movable cutter 326 is set at the distance B as shown in FIG. 13, that is, when the depth of cut is so small that the respective bottoms of the rectangular grooves 332 do not reach the fixed cutter 324, the photographic paper 310 has an uncut portion between each pair of adjacent rectangular grooves 332, thereby allowing the paper 310 to be perforated, whereas, when the working stroke of the movable cutter 326 is set at the distance C, the photographic paper 310 is cut over the whole area in the lateral direction thereof.

The folding section 314 is disposed on the downstream side of the cutting-perforating section 312 in the photographic paper transport direction. In this section 314, the photographic paper 310 is advanced forward by two pairs of guide rollers 334, 336 and 338, 340 and is then successively folded up along the perforations by means of a pair of sorter belts 342 and 344.

The sorter belts 342 and 344 are endless belts which are elliptically stretched between respective pairs of rollers 346 and 348. Arms 50 and 352 respectively project from the sorter belts 342 and 344 at predetermined spacings.

The pairs of rollers 346 and 348 are intermittently rotated in the directions of the arrows D by respective driving means such as motors (not shown). The arms 350 and 352 are controlled so that they move while facing each other.

The rollers 348 are adapted to be moved vertically as viewed in FIG. 12 by guide means (not shown) so as to move toward and away from the rollers 346. Thus, it is possible to dispose the rollers 348 in accordance with the size of images of the photographic paper 310 which is folded up as shown by the imaginary line on the arms 350 and 352.

By virtue of the rotation of the sorter belts 342 and 344, the folded photographic paper 354 is transported and dropped into an accommodating box 356 which is disposed on the downstream side of the sorter belt 342.

The operation of this embodiment will be explained below.

The photographic paper 310 which has images printed thereon by a printer (not shown) and has already been subjected to developing and drying processes is delivered to the cutting-perforating section 12 wherein it is passed through the area between the guide rollers 316 and 318 so as to be moved into the area between the fixed and movable cutters 324 and 326.

Figure 14:
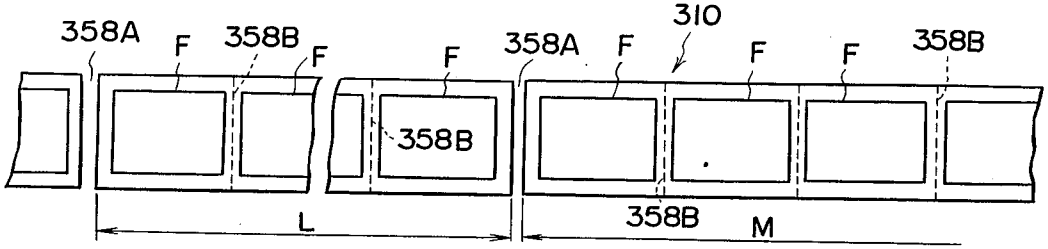
FIG. 14(A) is a plan view of a photographic paper in a continuous form.
FIG. 14(B) is a perspective view of the photographic paper which has already been folded in a zigzag shape.
Figure 14:
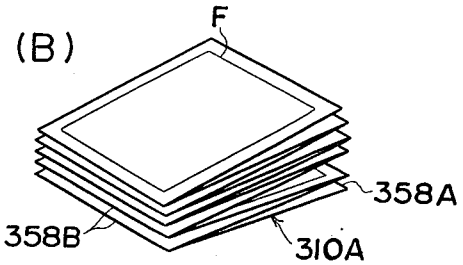

A sensor (not shown) detects the movement of the photographic paper 310 and activates the solenoid 328 on the basis of the position and size of the images porinted on the photographic paper 310. In this case, the photographic paper 310 is cut at each of the cutting areas 358A between series of images L' and M' printed in accordance with the orders placed by two different customers, by controlling the solenoid 328 in such a manner that the movable cutter 326 is moved through a relatively large working stroke, and the paper 310 is provided with a perforation 358B in the central portion between each pair of adjacent images F within those for each individual customer by controlling the solenoid 328 in such a manner that the movable cutter 326 is moved through a relatively small working stroke, as shown in FIG. 14(A).

The photographic paper 310 which has passed through the cutting-perforating section 312 then reaches the folding section 314 where it is advanced forward from the area between the guide rollers 338 and 340.

Figure 15:
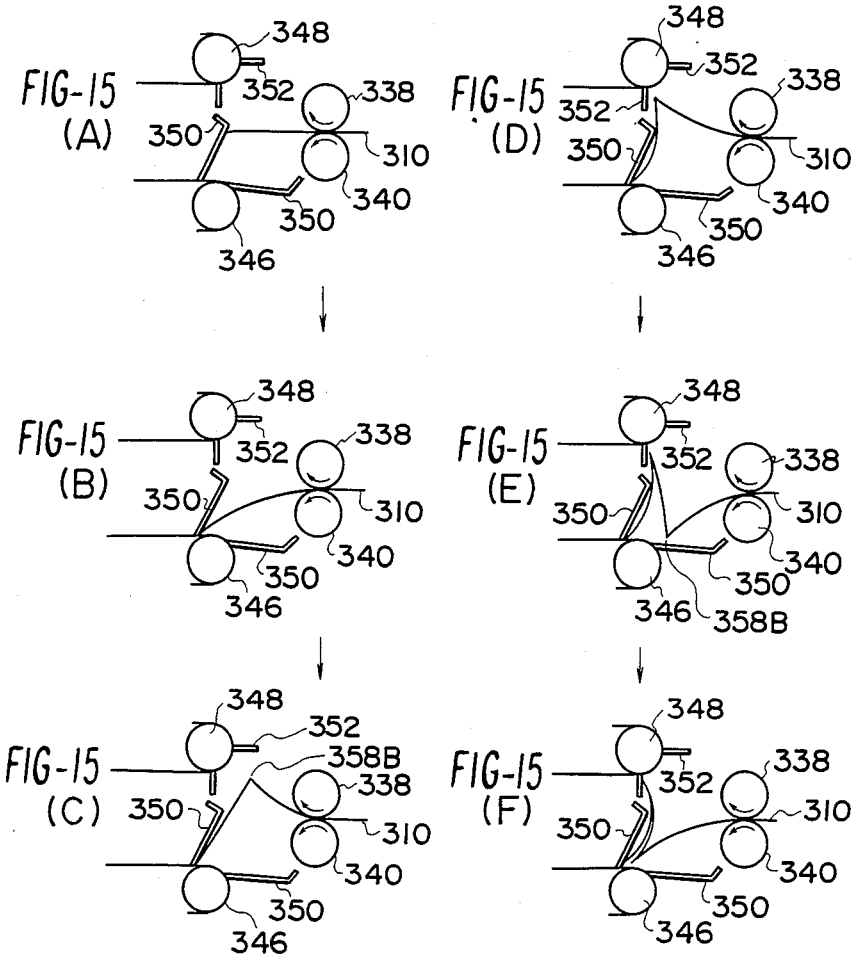
FIGS. 15(A) to 15(F) show in combination the way in which the photographic paper is folded.

Referring to FIG. 15(A), when the leading end portion of the photographic paper 310 is being advanced forward from the area between the guide rollers 338 and 340, a multiplicity of arms 350 and 352 are at rest in a state wherein two of them 350 and 352 oppose each other and respectively face the guide rollers 338 and 340, as also shown in FIG. 12.

In consequence, the leading end of the photographic paper 310 which is delivered from the guide rollers 338 and 340 comes in contact with the arm 350 as shown in FIG. 15(A). Since the distal end portion of the arm 350 is slightly slanted toward the guide rollers 338 and 340, the leading end of the photographic paper 310 slides on the arm 350 to reach the joint between the arm 350 and the sorter belt 342, as shown in FIG. 15(B).

When, in this state, the photographic paper 310 is further pushed out, the paper 310 is bent at the perforated intermediate portion 358B since the rigidity of this portion is relatively weak, and the perforated portion 358B is consequently pushed toward the arm 352, as shown in FIG. 15(C).

Referring next to FIG. 15(D), when the perforated portion 358B reaches the joint between the arm 352 and the sorter belt 344, the second perforated portion 358B which is subsequently pushed out from the guide rollers 338 and 340 is bent in such a manner as to extend toward the joint between the arm 352 and the sorter belt 342, whereby the photographic paper 310 is folded up as shown in FIGS. 15(E) and 15(F). After the second perforated portion 358B has reached the joint between the arm 350 and the sorter belt 342, the third perforated portion 358B is bent in the same direction as the first perforated portion 358B so as to reach the joint between the arm 352 and the sorter belt 344.

In this way, the photographic paper 310 is successively folded up in a zigzag shape along perforations 358B to define a folded photographic paper 310A as shown in FIG. 14(B). When this folding operation has been completed, the rollers 346 and 348 are rotated in the direction of the arrows D through a rotational angle corresponding to one pitch of the arms 350 and 352, so that the subsequent arms 350 and 352 respectively face the guide rollers 338 and 340. Thereafter, the photographic paper 310 is successively delivered from the guide rollers 338 and 340 and folded up for each order placed by each individual customer, each folded photographic paper 310A being retained on the arms 350 and 352 and between the sorter belts 342 and 344.

As the folding operation progresses, the first folded photographic paper 354 is released from the arms 350 and 352 so as to drop into the accommodating box 356.

Figure 16:
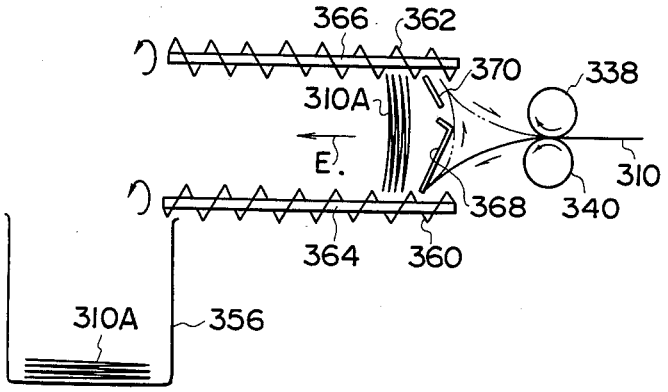
FIGS. 16 and 17 are sectional views respectively showing sixth and seventh embodiments of the present invention.

FIG. 16 show a folding section in accordance with a sixth embodiment of the present invention. In this embodiment, a pair of feed screws 360 and 362 are provided in place of the sorter belts 342 and 344. These feed screws 360 and 352 are disposed in such a manner that the respective shafts 364 and 366 thereof extend parallel to each other and also parallel to the direction of advancement of the photographic paper 310 delivered from the guide rollers 338 and 340. The feed screws 360 and 362 are respectively defined by spiral plate materials wound on the respective outer peripheries of the shafts 364 and 366, and adapted such that each folded photographic paper 310A is successively transported in the direction of the arrow E by virtue of the rotation of the feed screws 360 and 362.

A pair of guide plates 368 and 370 are disposed between the feed screws 360 and 362, the guide plates 368 and 370 being movable in a direction parallel to the respective axes of the guide rollers 338 and 340, so as to serve as the arms 350 and 352, respectively, in the above-described fifth embodiment.

Thus, in this embodiment the photographic paper 310 which is delivered from the guide rollers 338 and 340 is guided by the guide plates 368 and 370 so as be folded up in a zigzag shape, and the folded photographic paper 310A are retained at both ends thereof between the feed screws 360 and 362. Accordingly, every time a piece of photographic paper 310 for each order placed by each individual customer has been formed into a folded photographic paper 310A, the guide plates 368 and 370 are retracted in the direction parallel to the axes of the guide rollers 338 and 340, and the shafts 364 and 366 rotate one full turn. In consequence, the folded photographic paper 310A is advanced leftward as viewed in FIG. 16 through a distance corresponding to one pitch of the feed screws 360 and 362.

Thereafter, the guide plates 368 and 370 re-enter the area between the feed screws 360 and 362 in order to serve to fold a subsequently delivered piece of photographic paper 310 in a zigzag shape.

A guide plate for limiting the movement of the folded photographic paper 310A in a direction parallel to the plane thereof may be provided.

Figure 17:
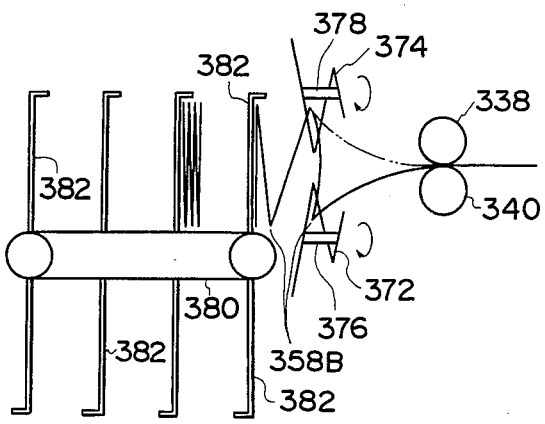

FIG. 17 shows a folding section in accordance with a seventh embodiment of the present invention.

In this embodiment, a pair of feed screws 372 and 374 are disposed on the downstream side of the guide rollers 338 and 340 in such a manner that the feed rollers 372 and 374 can be retracted in a direction parallel to the axes of the guide rollers 338 and 340. These feed screws 372 and 374 are respectively defined by spiral plate materials wound on the respective outer peripheries of shafts 376 and 378 in a manner similar to that of the feed screws 360 and 362 in the above-described sixth embodiment. However, the feed screws 372 and 374 in this embodiment have a relatively short axial length and are respectively wound on the shafts 376 and 378 about two turns. In addition, the feed screws 372 and 374 are gradually increased in radius toward arms 382 projecting from a sorter belt 380 which is disposed on the downstream side of the feed screws 372 and 374.

Thus, in this embodiment, when the feed screws 372 and 74 are continuously rotated synchronously with the delivery of the photographic paper 310, the paper 310 is successively folded up in a zigzag shape along perforations 358B, and transferred to an arm 382 of the sorter belt 380 which stands by for a folded photographic paper. An eighth embodiment includes a unitary severing and perforating cutter having a slanted notched blade as in FIG. 13 in combination with a carousel which clamps the folded packages as in FIG. 4.

It is a matter of course that various kinds of perforating means and photographic paper folding means other than the above-described ones may be employed in the present invention.

What is claimed is:

1. A photographic paper handling apparatus for handling a photographic paper in a continuous form having a plurality of images sequentially printed thereon, which comprises:

(a) a first section in which said photographic paper is transported along a photographic paper transport passage in a first direction, said first section comprising a means for cutting said photographic paper into pieces between adjacent images of different orders in a direction transverse to said first direction, each piece including a series of images printed in accordance with the order placed by each individual customer, and means for perforating said photographic paper in a direction transverse to said first direction between each pair of adjacent images; and (b) a second section disposed on the downstream side of said first section in the photographic paper transport direction, said second section comprising a means for transversely folding each of said cut and perforated pieces of photographic paper along each perforation, whereby it is possible to prevent prints processed in accordance with one order from being mixed with those in accordance with another order.

2. A photographic paper handling apparatus according to claim 1, wherein said perforating means is disposed on the downstream side of said means for cutting in the photographic paper transport direction.

3. A photographic paper handling apparatus according to claim 2, wherein said cutter means includes a fixed blade disposed on one side of said photographic paper transport passage, and a movable blade disposed on the other side and activated by drive means so as to move in a direction in which said photographic paper is cut thereby.

4. A photographic paper handling apparatus according to claim 3, wherein said perforating means includes a support plate on which said photographic paper is mounted, and a comb-like blade having a plurality of recesses formed in the distal end portion thereof.

5. A photographic paper handling apparatus according to claim 4, wherein said comb-like blade is supported by a movable plate which is movable toward and away from said support plate.

6. A photographic paper handling apparatus according to claim 5, wherein said movable plate is supported by a first fixed plate through a cam mechanism interposed therebetween, so that said movable plate is movable toward and away from said support plate.

7. A photographic paper handling apparatus according to claim 6, wherein said support plate is supported by a second fixed plate, said first and second fixed plates being movable along said photographic paper transport passage.

8. A photographic paper handling apparatus according to claim 3, wherein said perforating means includes a fixed blade on which said photographic paper is mounted, and a circular blade rolled on said fixed blade in the lateral direction of said photographic paper and having recesses formed in the outer peripheral portion thereof at a predetermined regular spacing.

9. A photographic paper handling apparatus according to claim 3, wherein said perforating means includes a fixed blade having recesses formed in the distal end portion thereof at a predetermined regular spacing, and a roller rolled on said fixed blade in the lateral direction of said photographic paper.

10. A photographic paper handling apparatus according to claim 3, wherein said perforating means includes a pair of rollers disposed in such a manner that the axes thereof extend in the lateral direction of said photographic paper, said rollers being adapted to transport said photographic paper while clamping the same, one of these rollers having substantially a fourth thereof cut as viewed in the axial direction thereof, said comb-like blade being rigidly secured to this cut portion.

11. A photographic paper handling apparatus according to claim 2, wherein said second section includes a pair of folding guides respectively disposed on both sides of said photographic paper transport passage in opposing relation to each other so as to define a gap therebetween for passing said photographic paper, the respective distal end portions of said folding guides being gradually reduced in wall thickness toward the downstream side in the photographic paper transport direction, and a bending roller disposed in opposing relation to the respective distal end portions of said folding guides and in such a manner that the axis of said bending roller extends in the lateral direction of said photographic paper, said bending roller being movable across said photographic paper transport passage, so that a portion of said photographic paper which projects from the respective distal end portions of said folding guides through said gap is folded by virtue of the movement of said bending roller.

12. A photographic paper handling apparatus according to claim 1, wherein said first section includes a fixed cutter disposed on one side of said photographic paper transport passage, and a movable cutter disposed on the other side and movable across said photographic paper transport passage, said movable cutter having a cutting edge slanted with respect to the plane of said photographic paper, said cutting edge having a plurality of rectangular grooves formed in the distal end portion thereof at a predetermined regular spacing.

13. A photographic paper handling apparatus according to claim 12, wherein said plurality of rectangular grooves are formed in such a manner that the respective bottom surfaces thereof are substantially flush with each other.

14. A photographic paper handling apparatus according to claim 13, wherein said second section includes a pair of sorter belts respectively disposed on both sides of said photographic paper transport passage, each sorter belt being stretched between a pair of rollers rotated intermittently in such a manner that the longer portions of each sorter belt extend substantially parallel to said transport passage, and arms projecting outward from the respective outer peripheries of said pair of sorter belts in such a manner that said arms oppose each other, so that said photographic paper is brought into contact with said arms so as to be folded and received between said sorter belts.

15. A photographic paper handling apparatus according to claim 13, wherein said second section includes: a pair of feed screws respectively disposed on both sides of said photographic paper transport passage in such a manner that the axis of each of said feed screws extends parallel to said photographic paper transport passage, each feed screw having a spiral plate material wound on the outer periphery thereof, and said feed screws being rotated about the respective axes thereof in the same direction as each other; and a guide disposed in such a manner as to be able to advance into and retract from the area defined between said feed screws so as to fold said photographic paper which is brought into contact with said guide, so that said photographic paper folded by said guide is received between said pair of feed screws.

16. A photographic paper handling apparatus according to claim 13, wherein said second section includes a pair of guide rolls respectively disposed on both sides of said photographic paper transport passage in such a manner that the axis of each of said guide rollers extends parallel to said transport passage, each guide roller having a spiral plate material wound on the outer periphery thereof, and a sorter belt disposed on the downstreatm side of said guide rollers in the photographic paper transport direction and having an arm projecting outward from the outer peripheral portion thereof, so that said photographic paper folded by said guide rollers is received by said arm on said sorter belt.

17. A photographic paper handling apparatus according to claim 12, further comprising a cassette disposed on the downstream side of said folding means in the photographic paper transport direction and having a plurality of accommodating portions each adapted to accommodate the folded photographic paper by clamping it.

18. A photographic paper handling apparatus according to claim 17, wherein said cassette is rotatable about the axis thereof, said accommodating portions being radially formed on the outer peripheral portion of said cassette.

19. A photographic paper handling apparatus according to claim 18, wherein clamping means is provided between said folding means and said cassette, said clamping means being adapted to insert said folded photographic paper into an accommodating portion of said cassette while clamping said paper in the direction of thickness thereof.

20. A photographic paper handling apparatus according to claim 19, wherein said clamping means has a pair of clamping plates adapted to be movable toward and away from each other, so that said folded photographic paper is clamped by said clamping plates in the thicknesswise direction thereof and inserted into an accommodating portion of said cassette.

21. A photographic paper handling apparatus according to claim 20, wherein said clamping plates respectively have rubber plates rigidly secured to their opposing surfaces.

22. A photographic paper handling apparatus according to claim 2, wherein said second section has a pair of folding guides respectively disposed on both sides of said photographic paper transport passage and each having a distal end portion with a wedge-like cross-section which is tapered toward the downstream side in the photographic paper transport direction, a bending member disposed in opposing relation to the respective distal end portions of said folding guides and adapted to bend a portion of said photographic paper projecting from said folding guides, and adjusting means for moving said bending member toward and away from the respective distal end portions of said folding guides in the photographic paper transport direction.

23. A photographic paper handling apparatus for handling a photographic paper in a continuous form having a plurality of images sequentially printed thereon, which comprises:

(a) cutter means for cutting said photographic paper between adjacent images of different orders in a direction transverse to the direction said photographic paper is transported along a photographic paper transport passage, said photographic paper being cut into pieces each including a series of images printed in accordance with the order placed by each individual customer;

(b) perforating means disposed adjacent to and on the downstream side of said cutter means in the photographic paper transport direction and adapted to provide a perforation transverse relative to the direction said photographic paper is transported between each pair of adjacent images;

(c) folding means disposed adjacent to and on the downstream side of said perforating means in the photographic paper transport direction and adapted to fold each of said cut pieces of the photographic paper along each perforation; and (d) a cassette disposed on the downstream side of said folding means and having a plurality of accommodating portions each adapted to accommodate the folded photographic paper by clamping it in the direction of thickness thereof, whereby it is possible to prevent prints processed in accordance with one order from being mixed with those in accordance with another order.

24. A photographic paper handling apparatus according to claim 23, wherein said cutter means includes a fixed blade disposed on one side of said photographic paper transport passage, and a movable blade disposed on the other side and activated by drive means so as to move in a direction in which said photographic paper is cut thereby.

25. A photographic paper handling apparatus according to claim 24, wherein said perforating means includes a support plate on which said photographic paper is mounted, and a comb-like blade having a plurality of recesses formed in the distal end portion thereof.

26. A photographic paper handling apparatus according to claim 25, wherein said comb-like blade is supported by a movable plate which is movable toward and away from said support plate.

27. A photographic paper handling apparatus according to claim 26, wherein said movable plate is supported by a first fixed plate through a cam mechanism interposed therebetween, so that said movable plate is movable toward and away from said support plate.

28. A photographic paper handling apparatus according to claim 27, wherein said support plate is supported by a second fixed plate, said first and second fixed plates being movable along said photographic paper transport passage.

29. A photographic paper handling apparatus according to claim 24, wherein said perforating means includes a fixed blade on which said photographic paper is mounted, and a circular blade rolled on said fixed blade in the lateral direction of said photographic paper and having recesses formed in the outer peripheral portion thereof at a predetermined regular spacing.

30. A photographic paper handling apparatus according to claim 24, wherein said perforating means includes a fixed blade having recesses formed in the distal end portion thereof at a predetermined regular spacing, and a roller rolled on said fixed blade in the lateral direction of said photographic paper.

31. A photographic paper handling apparatus according to claim 24, wherein said perforating means includes a pair of rollers disposed in such a manner that the axes thereof extend in the lateral direction of said photographic paper, said rollers being adapted to transport said photographic paper while clamping the same, one of these rollers having substantially a fourth thereof cut as viewed in the axial direction thereof, said comb-like blade being rigidly secured to this cut portion.

32. A photographic paper handling apparatus according to claim 23, wherein said second section includes a pair of folding guides respectively disposed on both sides of said photographic paper transport passage in opposing relation to each other so as to define a gap therebetween for passing said photographic paper, the respective distal end portions of said folding guides being gradually reduced in wall thickness toward the downstream side in the photographic paper transport direction, and a bending roller disposed in opposing relation to the respective distal end portions of said folding guides and in such a manner that the axis of said bending roller extends in the lateral direction of said photographic paper, said bending roller being movable across said photographic paper transport passage, so that a portion of said photographic paper which projects from the respective distal end portions of said folding guides through said gap is folded by virtue of the movement of said bending roller.

33. A photographic paper handling apparatus according to claim 23, wherein said cassette is rotatable about the axis thereof, said accommodating portions being radially formed on the outer peripheral portion of said cassette.

34. A photographic paper handling apparatus according to claim 33, wherein clamping means is provided between said folding means and said cassette, said clamping means being adapted to insert said folded photographic paper into an accommodating portion of said cassette while clamping said paper in the direction of thickness thereof.

35. A photographic paper handling apparatus according to claim 34, wherein said clamping means has a pair of clamping plates adapted to be movable toward and away from each other, so that said folded photographic paper is clamped by said clamping plates in the thicknesswise direction thereof and inserted into an accommodating portion of said cassette.

36. A photographic paper handling apparatus according to claim 35, wherein said clamping plates respectively have rubber plates rigidly secured to their opposing surfaces.

37. A photographic paper handling apparatus according to claim 23, wherein said second section has a pair of folding guides respectively disposed on both sides of said photographic paper transport passage and each having a distal end portion with a wedge-like cross-section which is tapered toward the downstream side in the photographic paper transport direction, a bending member disposed in opposing relation to the respective distal end portions of said folding guides and adapted to bend a portion of said photographic paper projecting from said folding guides, and adjusting means for moving said bending member toward and away from the respective distal end portions of said folding guides in the photographic paper transport direction.

* * * * *